US012617504B2

(12) United States Patent
Inoue

(10) Patent No.: US 12,617,504 B2
(45) Date of Patent: May 5, 2026

(54) WATERCRAFT TROUBLESHOOTING SYSTEM

(71) Applicant: YAMAHA HATSUDOKI KABUSHIKI KAISHA, Iwata (JP)

(72) Inventor: Hiroshi Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 154 days.

(21) Appl. No.: 18/435,100

(22) Filed: Feb. 7, 2024

(65) Prior Publication Data

US 2024/0270358 A1 Aug. 15, 2024

(30) Foreign Application Priority Data

Feb. 10, 2023 (JP) ..... 2023-018940

(51) Int. Cl.
*B63B 79/30* (2020.01)

(52) U.S. Cl.
CPC ..... *B63B 79/30* (2020.01)

(58) Field of Classification Search
CPC ..... B63B 79/30
See application file for complete search history.

(56) References Cited

U.S. PATENT DOCUMENTS

2007/0299575 A1* 12/2007 Yamada ..... G07C 5/008 701/31.4
2010/0305789 A1 12/2010 Ito
2017/0365107 A1* 12/2017 Jeong ..... G07C 5/008
2018/0091930 A1* 3/2018 Jefferies ..... G07C 9/00571
2020/0339235 A1* 10/2020 Inoue ..... B63B 79/30
2020/0339236 A1* 10/2020 Bamba ..... B63B 79/40

FOREIGN PATENT DOCUMENTS

JP 2010-274854 A 12/2010

OTHER PUBLICATIONS

Inoue et al., "Watercraft Information Collecting System", U.S. Appl. No. 18/962,242, filed Nov. 27, 2024. Consideration limited to Spec, Claims, Drawings. See MPEP § 609.04 (a) (II).

* cited by examiner

*Primary Examiner* — Stephen Holwerda
(74) *Attorney, Agent, or Firm* — Keating & Bennett, LLP

(57) ABSTRACT

A watercraft troubleshooting system includes an onboard system including watercraft devices provided on a watercraft, and an onboard network provided on the watercraft and connected to the watercraft devices, each of which includes a communication terminal communicable with the other watercraft devices via the onboard network. The watercraft troubleshooting system further includes a server outside the watercraft and communicable with the communication terminal. The communication terminal is configured or programmed to perform a system scanning operation to collect information about the watercraft devices, and to perform a scanning result transmitting operation to transmit the information collected by the system scanning operation as a scanning result to the server. The server is configured or programmed to evaluate the scanning result transmitted thereto from the communication terminal to generate an evaluation result, and to transmit the evaluation result to the communication terminal.

17 Claims, 7 Drawing Sheets

WATERCRAFT TROUBLESHOOTING SYSTEM

CROSS REFERENCE TO RELATED APPLICATIONS

This application claims the benefit of priority to Japanese Patent Application No. 2023-018940 filed on Feb. 10, 2023. The entire contents of this application are hereby incorporated herein by reference.

BACKGROUND OF THE INVENTION

1. Field of the Invention

The present invention relates to watercraft troubleshooting systems. The present invention also relates to communication units and servers for use in the watercraft troubleshooting systems. Further, the present invention relates to watercraft each including an onboard system to be used in the watercraft troubleshooting systems.

2. Description of the Related Art

US 2020/0339235 A1 discloses a troubleshooting device that can be connected to an onboard LAN (Local Area Network) provided in a watercraft. An outboard motor ECU (Electronic Control Unit), an input device, a control device, a display device, and an output device are connected to the onboard LAN. The troubleshooting device can be connected to the onboard LAN via a LAN cable and, therefore, can communicate with the devices (watercraft devices) connected to the onboard LAN to acquire information from the plurality of watercraft devices. On the other hand, the troubleshooting device can communicate with a server via a WAN (Wide Area Network) such as the internet. The server provides information to be used to troubleshoot the devices.

The troubleshooting device is owned by a boat builder or a dealer. Therefore, a typical user, i.e., a troubleshooting operator, is a service person of the boat builder or the dealer. The troubleshooting operator connects the troubleshooting device to the onboard LAN when required. The troubleshooting device collects information about all the devices connected to the onboard LAN, and acquires information necessary for the troubleshooting from the server based on the collected information. Specifically, the troubleshooting device acquires operation conditions required for the normal operation of the watercraft devices from the server. Based on the acquired operation conditions, the troubleshooting device determines whether or not the devices each normally operate, and displays a determination result.

SUMMARY OF THE INVENTION

The inventor of example embodiments of the present invention described and claimed in the present application conducted an extensive study and research regarding watercraft troubleshooting systems, such as the one described above, and in doing so, discovered and first recognized new unique challenges and previously unrecognized possibilities for improvements as described in greater detail below.

With the use of the troubleshooting device described above, the troubleshooting operator can easily know the satisfaction/nonsatisfaction of the compatibility requirements of the hardware and the software of the plurality of watercraft devices. Thus, the troubleshooting operator can determine whether or not a constructed onboard system can function as required by a customer.

The troubleshooting is typically performed after the onboard system is newly constructed in the watercraft before the watercraft is delivered to the customer. Further, where a new device is incorporated in the existing onboard system, the troubleshooting is thereafter performed to check if the onboard system with the new device incorporated therein properly functions. When any trouble is found, appropriate measures are taken against the trouble and the troubleshooting is performed again. Then, the watercraft is delivered to the customer.

The troubleshooting device disclosed in US 2020/0339235 A1 is a service-dedicated tool to be owned by the boat builder or the dealer. Therefore, the troubleshooting requires an operation such that the troubleshooting device is first connected to the onboard LAN and then the troubleshooting operator operates the troubleshooting device. In many cases, however, watercraft devices to be provided in combination in the watercraft are properly selected, and the onboard system is properly constructed. Therefore, the troubleshooting operation to be performed with the use of the troubleshooting device is simply to check if the onboard system is properly constructed, mostly without the need to take measures against any trouble. Accordingly, it is preferred to reduce the time and the effort required for the troubleshooting by further simplifying the troubleshooting operation.

Example embodiments of the present invention provide watercraft troubleshooting systems that are advantageous to reduce time and effort required to troubleshoot an onboard system, and communication terminals and servers for the watercraft troubleshooting system.

Another example embodiment of the present invention provides a watercraft including an onboard system to be used for the watercraft troubleshooting system.

In order to overcome the previously unrecognized and unsolved challenges described above, an example embodiment of the present invention provides a watercraft troubleshooting system including an onboard system including a plurality of watercraft devices provided on a watercraft, and an onboard network provided on the watercraft and connected to the plurality of watercraft devices. The plurality of watercraft devices include a communication terminal communicable with others of the plurality of watercraft devices via the onboard network. The watercraft troubleshooting system further includes a server outside the watercraft and communicable with the communication terminal. The communication terminal is configured or programmed to perform a system scanning operation to collect information about the plurality of watercraft devices, and to perform a scanning result transmitting operation to transmit the information collected by the system scanning operation as a scanning result to the server. The server is configured or programmed to evaluate the scanning result transmitted thereto from the communication terminal to generate an evaluation result, and to transmit the evaluation result to the communication terminal.

With this arrangement, the onboard system is configured to connect the plurality of watercraft devices to the onboard network, and the communication terminal is provided as one of the plurality of watercraft devices. The communication terminal is communicable with the other watercraft devices via the onboard network, and is also communicable with the server outside the watercraft. In an example embodiment, the communication terminal performs the system scanning operation to collect the information about the plurality of watercraft devices, and transmits the scanning result to the server. The server evaluates the scanning result, and transmits the evaluation result to the communication terminal.

Therefore, this arrangement makes it possible to perform the system scanning operation and acquire the evaluation result of the system scanning without connecting a service-dedicated tool not contained in the onboard system to the onboard network. When the onboard system is properly constructed and the result of the evaluation of the scanning result is correspondingly excellent, therefore, the troubleshooting operation requiring the connection of the service-dedicated tool can be omitted. Thus, the time and the effort required to troubleshoot the onboard system can be reduced.

In an example embodiment of the present invention, the communication terminal is configured or programmed to perform the system scanning operation at a startup of the onboard system. This arrangement makes it possible to perform the system scanning operation and acquire the evaluation result of the system scanning when the onboard system is started up after the onboard system is newly constructed or the configuration of the onboard system is modified. In this case, therefore, the troubleshooting operation requiring the connection of the service-dedicated tool can be omitted when the onboard system includes a proper configuration.

In an example embodiment of the present invention, the communication terminal is configured or programmed to perform the system scanning operation when a new watercraft device is connected to the onboard network. This arrangement makes it possible to perform the system scanning operation and acquire the evaluation result of the system scanning when the new watercraft device is connected to the onboard network to change the configuration of the onboard system during the operation of the onboard system. In this case, therefore, the troubleshooting operation requiring the connection of the service-dedicated tool can be omitted when the onboard system includes a proper configuration.

In an example embodiment of the present invention, the communication terminal includes a scanning result memory to store the scanning result, and is configured or programmed to perform the scanning result transmitting operation when information newly collected as a new scanning result by the system scanning operation is inconsistent with the previous scanning result stored in the scanning result memory.

With this arrangement, when the new scanning result is inconsistent with the previous scanning result, the new scanning result is transmitted to the server and evaluated by the server. When the new scanning result is consistent with the previous scanning result, on the other hand, the scanning result transmitting operation is omitted and, therefore, the new scanning result is not evaluated in the server. This makes it possible to reduce the effort for the troubleshooting operation requiring the connection of the service-dedicated tool, while alleviating loads on the communication terminal and the server.

In an example embodiment of the present invention, the communication terminal includes an evaluation result memory to store the evaluation result transmitted thereto from the server. The communication terminal is configured or programmed to perform the scanning result transmitting operation whether the new scanning result is consistent or inconsistent with the previous scanning result stored in the scanning result memory when no evaluation result is stored in the evaluation result memory. This arrangement prevents the scanning result from being left unevaluated by the server. This makes it possible to reliably evaluate whether or not the onboard system is properly constructed.

In an example embodiment of the present invention, the server is configured or programmed to determine compatibility among the plurality of watercraft devices to generate an evaluation result including the result of the compatibility determination, and to transmit the evaluation result thus generated to the communication terminal. With this arrangement, the compatibility among the plurality of watercraft devices of the onboard system is determined making it possible to determine, based on the evaluation result, whether or not the plurality of watercraft devices each properly operate.

In an example embodiment of the present invention, the scanning result to be transmitted to the server by the communication terminal includes hardware information and software information about each of the plurality of watercraft devices. This arrangement makes it possible to evaluate hardware compatibility and software compatibility among the plurality of watercraft devices in the server.

In an example embodiment of the present invention, the plurality of watercraft devices include a display to display the evaluation result transmitted to the communication terminal. With this arrangement, the evaluation result received from the server is displayed on the display which is one of the plurality of watercraft devices of the onboard system. This makes it possible to know the evaluation result without the connection of the service-dedicated tool, thus reducing the time and the effort required for the troubleshooting operation.

In an example embodiment of the present invention, the evaluation result includes an acceptability determination result indicating whether or not the onboard system is properly constructed, and further includes information about an unacceptable matter or a coping method to eliminate the unacceptable matter when the determination result is unacceptable.

The evaluation result typically includes the acceptability determination result indicating whether or not the onboard system is properly constructed. When the determination result is unacceptable, the evaluation result may include the information about the unacceptable matter. The evaluation result may further include the information about the coping method to eliminate the unacceptable matter when the determination result is unacceptable. Such information makes it possible to know how the onboard system should be corrected without the connection of the service-dedicated tool, even when the determination result is unacceptable. This reduces the time and the effort required to troubleshoot the onboard system.

In an example embodiment of the present invention, the plurality of watercraft devices include a propulsion device to apply a propulsive force to the hull of the watercraft. The communication terminal transmits operation information indicating the operation state of the propulsion device to the server during the operation of the onboard system.

With this arrangement, the operation information about the propulsion device can be transmitted from the communication terminal to the server, and accumulated in the server. Therefore, the operation state of the propulsion device can be checked based on the information accumulated in the server. In other words, the communication terminal, which is mounted on the watercraft to monitor the operation state of the propulsion device, is used to perform the system scanning operation and transmit the scanning result to the server and to receive the evaluation result from the server.

The communication terminal may transmit the operation information about the propulsion device to the server, for example, in a predetermined periodic transmission cycle. Typically, a cycle in which the communication terminal collects the operation information about the propulsion device is shorter than the periodic transmission cycle.

The propulsion device may be an outboard motor. Besides the outboard motor, the propulsion device may be an inboard motor, an inboard/outboard motor, a waterjet propulsion device or other type of a propulsion device.

In an example embodiment of the present invention, the communication terminal is configured or programmed to inform the server about a total number data indicating the total number of data items to be transmitted to the server, and transmit the data items respectively assigned with serial numbers to the server in the scanning result transmitting operation. The server determines, based on the total number data and the serial numbers, whether or not all the data items are received.

The serial numbers are consecutive integers (typically, consecutive incremental integers) starting with a predetermined initial value (typically, 0 or 1). The data items each typically include a data body indicating information collected from the watercraft device, and the serial number data.

With this arrangement, the server can confirm the reception of all the data items based on the total number data and the serial numbers. That is, the server can check a transmission error (a missing data item).

When the transmission error is present, the server informs the communication terminal about the transmission error. The information about the transmission error may be a retransmission request. The retransmission request is a request for retransmission of at least an unreceived data item. The retransmission request may be a request for retransmission of all the data items, or may be a request for retransmission of partial data including the unreceived data item (i.e., the missing data item).

In an example embodiment of the present invention, the communication terminal is configured or programmed so that, when a plurality of communication terminals are connected to the onboard network, only one of the communication terminals selected based on a predetermined rule is enabled to perform the system scanning operation and the scanning result transmitting operation, and other of the communication terminals are disabled from performing the system scanning operation and the scanning result transmitting operation.

With this arrangement, only one of the communication terminals connected to the onboard network performs the system scanning operation and the scanning result transmitting operation. Even when two or more communication terminals are connected to the onboard system, therefore, the communication terminals are prevented from performing the system scanning operation and/or the scanning result transmitting operation in an overlapping manner. Thus, the overlapping operation in the onboard system can be eliminated. Since overlapping information is not transmitted to the server, the load on the server can be reduced. When the plurality of communication terminals are connected to the onboard network and one of the communication terminals fails, on the other hand, another of the communication terminals can function in place of the failing communication terminal. This makes it possible to perform the system scanning operation and the scanning result transmitting operation while providing communication with the server. This reduces the time and the effort for the troubleshooting requiring the connection of the service-dedicated tool.

In an example embodiment of the present invention, the plurality of watercraft devices are each configured or programmed to transmit, to the onboard network, type specification information that specifies the device type thereof at the startup of the onboard system. Where an address to be used on the onboard network is predefined according to the type of the watercraft device, for example, the address can be an example of the type specification information. That is, the plurality of watercraft devices each perform a so-called address claim procedure to output a use address to the onboard network to claim the use address at the startup of the onboard system, thus informing the other watercraft devices about the device type thereof. In other words, the interpretation of the use address outputted to the onboard network makes it possible to know the type of the watercraft device that outputs the use address.

In an example embodiment of the present invention, the plurality of watercraft devices are each configured or programmed to output, to the onboard network, individual identification information (hardware identification information) uniquely assigned thereto in addition to the type specification information at the startup of the onboard network. The individual identification information can be a unique number assigned to each of the devices. When the type specification information received from the onboard network indicates that another of the plurality of watercraft devices is a second communication terminal, the first communication terminal may compare the individual identification information of the another watercraft device with its individual identification information, and may determine, based on the result of the comparison, whether its own function is to be enabled or disabled. More specifically, when another watercraft device outputs a use address specific to the communication terminal to the onboard network, the first communication terminal may compare the unique number of the another watercraft device with its unique number (e.g., in size) to determine whether its own function is to be enabled or disabled.

In an example embodiment of the present invention, the plurality of watercraft devices are each configured or programmed to output an error code indicating the presence or absence of an error to the onboard network at the startup of the onboard system and (e.g., periodically) after the startup of the onboard system. When the error code indicating the presence of the error appears on the onboard network at the startup of the onboard system or when the error code is changed after the startup of the onboard system, the communication terminal transmits the error code to the server.

With this arrangement, the function of the communication terminal makes it possible to transmit the error codes of the respective watercraft devices of the onboard system to the server. Information about the error codes may be accumulated in the server such that the troubleshooting can be performed on the onboard system based on the accumulated information. When the error code indicating the presence of the error appears at the startup of the onboard system, the communication terminal transmits the error code to the server. Otherwise, the communication terminal transmits no error code. This makes it possible to inform the server about the presence of the error with a minimum amount of communication. When the error code is changed after the startup of the onboard system, the communication terminal transmits the error code to the server. Otherwise, the communication terminal transmits no error code. This makes it possible to inform the server about the error states of the respective watercraft devices with a minimum amount of communication.

The error code may indicate the type of the error as well as the presence or absence of the error. In this case, a greater amount of information can be accumulated in the server, making it possible to perform the troubleshooting more precisely.

Another example embodiment of the present invention provides a watercraft including a hull, and the watercraft troubleshooting system including any of the above-described features.

Another further example embodiment of the present invention provides the communication terminal for use in the watercraft troubleshooting system including any of the above-described features.

Still another example embodiment of the present invention provides the server for use in the watercraft troubleshooting system including any of the above-described features.

Further another example embodiment of the present invention provides a watercraft troubleshooting system including a plurality of watercraft devices provided on a watercraft, an onboard network provided on the watercraft and connected to the plurality of watercraft devices, a communication terminal communicable with the plurality of watercraft devices via the onboard network, and a server communicable with the communication terminal. The communication terminal is configured or programmed to collect information about the plurality of watercraft devices and to transmit the information to the server. The server is configured or programmed to evaluate the information transmitted thereto from the communication terminal to generate an evaluation result and to transmit the evaluation result to the communication terminal.

In an example embodiment of the present invention, the plurality of watercraft devices include a scanner to perform a system scanning operation to collect information about the plurality of watercraft devices via the onboard network, and the communication terminal includes the scanner, and a communicator to transmit the information collected by the scanner as a scanning result to the server and receive the evaluation result from the server.

Still another example embodiment of the present invention provides a communication terminal mounted on a watercraft and communicable with a server. The communication terminal includes a communication interface connected to an onboard network provided on the watercraft, a wireless communicator to communicate with the server, and a processor. The processor is configured or programmed to function as a scanner to collect, via the communication interface, information about a device provided on the watercraft and connected to the onboard network (system scanning function), a scanning result transmitter to cause the wireless communicator to transmit the information collected by the scanner as a scanning result to the server (scanning result transmitting function), and an evaluation result receiver to cause the wireless communicator to receive the result of evaluation of the transmitted information from the server (evaluation result receiving function).

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Figure 1:
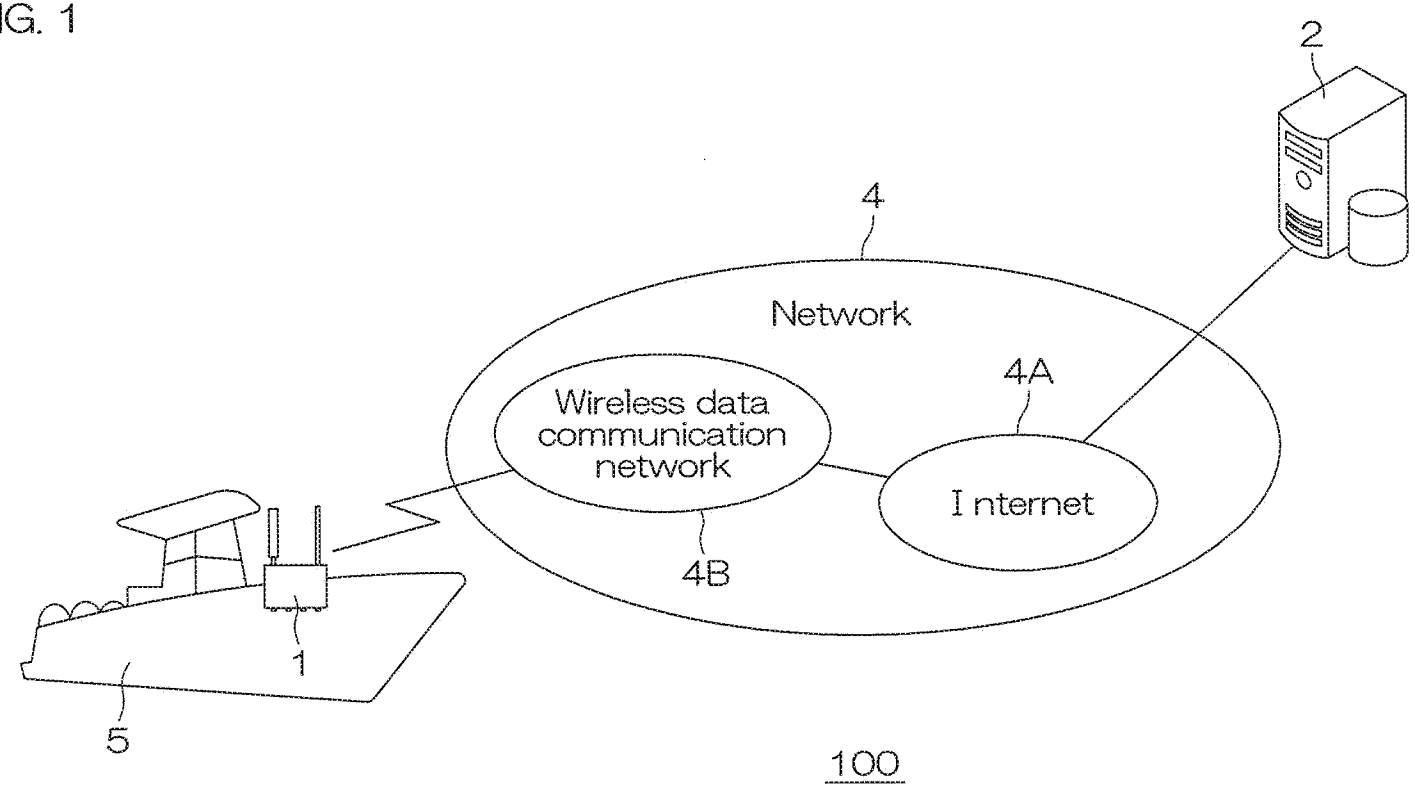
FIG. 1 is a schematic diagram of a watercraft troubleshooting system according to an example embodiment of the present invention.

FIG. 1 is a schematic diagram of a watercraft troubleshooting system 100 according to an example embodiment of the present invention. The watercraft troubleshooting system 100 includes a communication terminal 1 that collects and transmits information about devices provided on or in a watercraft 5, and a server 2 that communicates with the communication terminal 1. The communication terminal 1 may be provided in the watercraft 5. Further, the communication terminal 1 may be portable, so that a crew member can bring the communication terminal 1 into or onto the watercraft 5 as required.

The communication terminal 1 and the server 2 can communicate with each other via a network 4. That is, the communication terminal 1 and the server 2 are each connected to the network 4 in a communicable manner. The network 4 typically includes the internet 4A. The communication terminal 1 is connected in a communicable manner to a wireless data communication network 4B such as a mobile phone network, and is connected to the internet 4A in a communicable manner via the wireless data communication network 4B.

Figure 2:
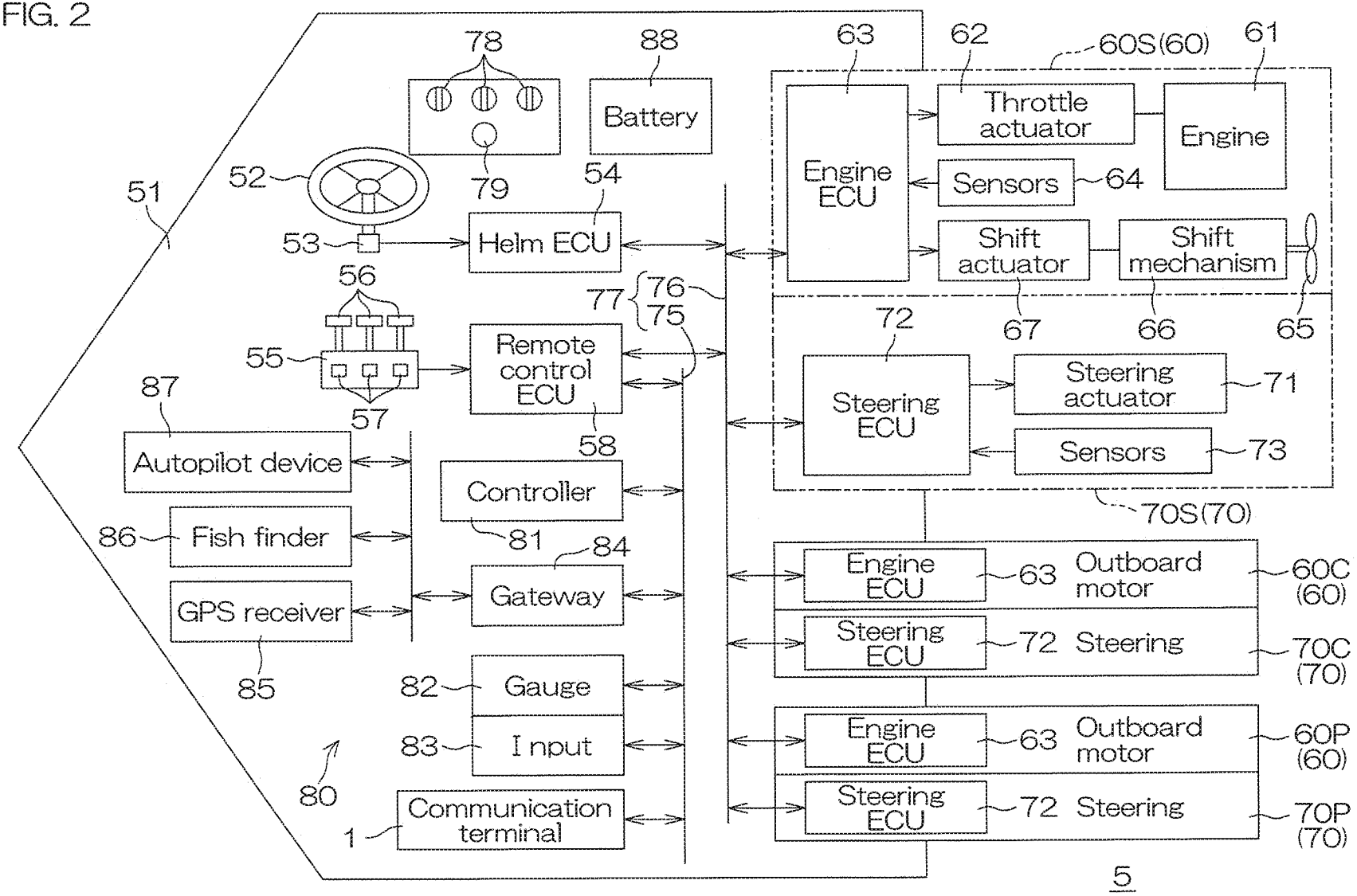
FIG. 2 is a block diagram showing a configuration of a watercraft by way of example.

FIG. 2 is a block diagram showing the configuration of the watercraft 5. The watercraft 5 includes a hull 51, and various devices (watercraft devices) provided on the hull 51. The plurality of watercraft devices typically include an input device to maneuver the watercraft (watercraft maneuvering device), a controller 81 that comprehensively controls the devices provided on the watercraft 5, a propulsion device that applies a propulsive force to the hull 51, and a steering device (watercraft maneuvering device) that changes the advancing direction of the hull 51. In an example embodiment, the communication terminal 1 is one of the plurality of watercraft devices.

In the present example, the input device includes a steering wheel 52 and a remote controller 55.

In an example embodiment, the propulsion device includes an outboard motor 60 as an exemplary main device (main propulsion device). Specifically, the outboard motor 60 includes one or more outboard motors 60 provided on the stern of the hull 51. In the present example, a plurality of outboard motors 60 (more specifically, three outboard motors 60) are disposed side by side and attached to the stern. In the present example, the outboard motors 60 are engine outboard motors each including an engine 61 (internal combustion engine) as a power source to drive a propeller 65. Of course, electric outboard motors each including an electric motor as a power source may be used instead. Specifically, the three outboard motors 60 include a middle outboard motor 60C disposed in the middle, and a port-side outboard motor 60P and a starboard-side outboard motor 60S disposed on the left side and the right side of the middle outboard motor 60C.

In an example embodiment, the steering device includes steerings 70 that respectively steer the outboard motors 60 leftward and rightward. The steerings 70 are provided in one-to-one correspondence with the outboard motors 60. In the present example, three steerings 70 are provided. The three steerings 70 include a middle steering 70C, a port-side steering 70P and a starboard-side steering 70S respectively corresponding to the middle outboard motor 60C, the port-side outboard motor 60P, and the starboard-side outboard motor 60S.

The steering wheel 52 is turned by a watercraft operator. The operation angle of the steering wheel 52 is detected by an operation angle sensor 53, and inputted to a helm ECU (Electronic Control Unit) 54. The remote controller 55 includes acceleration levers 56 operable by the watercraft operator to adjust the directions (forward or reverse directions) and the magnitudes of propulsive forces to be generated by the respective outboard motors 60. The operation positions of the acceleration levers 56 are respectively detected by acceleration position sensors 57, and inputted to a remote control ECU 58.

The outboard motors 60 each include the engine 61, the propeller 65 that is driven by the engine 61, a shift mechanism 66, and an engine ECU 63. The shift mechanism 66 includes a plurality of shift positions, i.e., a forward shift position, a reverse shift position, and a neutral shift position. With the shift position set to the forward shift position, the propeller 65 is rotated in a forward rotation direction by the driving force of the engine 61. With the shift position set to the reverse shift position, the propeller 65 is rotated in a reverse rotation direction by the driving force of the engine 61. With the shift position set to the neutral shift position, power transmission between the engine 61 and the propeller 65 is cut off. The engine ECU 63 controls the operation of a shift actuator 67 that actuates the shift mechanism 66 to control the direction of the propulsive force. Further, the engine ECU 63 controls the operation of a throttle actuator 62 that drives the throttle valve of the engine 61 to control the magnitude of the propulsive force.

The steerings 70 each include a steering actuator 71 and a steering ECU 72 that controls the steering actuator 71. The steering actuator 71 generates power to pivot the corresponding outboard motor 60 leftward and rightward about its steering shaft (not shown). Thus, the direction of the propulsive force applied to the hull 51 by the outboard motor 60 is changed leftward and rightward such that the advancing direction of the watercraft 5 is changed. The steering 70 may be unitary with the corresponding outboard motor 60, or may be separate from the outboard motor 60. In FIG. 2, the steering 70 and the outboard motor 60 are configured as a unitary unit by way of example (e.g., the steering 70 is incorporated in the outboard motor 60).

A data communication network, i.e., an onboard network 77, is provided on the watercraft 5. In an example embodiment, the onboard network 77 includes a watercraft control CAN (e.g., Control Area Network) 75 and a propulsion device control CAN 76. The onboard network 77 may further include a number of daughter networks. The onboard network 77 and various watercraft devices connected to the onboard network 77 define an onboard system 80.

The remote control ECU 58, the helm ECU 54, the engine ECUs 63 of the respective outboard motors 60, and the steering ECUs 72 of the respective steerings 70 are connected to the propulsion device control CAN 76. Therefore, an output command from the remote control ECU 58 is transmitted to the engine ECUs 63 via the propulsion device control CAN 76. The output command is a signal to be applied to command the directions (forward or reverse directions) and the magnitudes of the propulsive forces of the respective outboard motors 60. Further, a steering command from the helm ECU 54 is transmitted to the steering ECUs 72 via the propulsion device control CAN 76. The steering command is a command signal to command the steering directions and the steering angles of the respective outboard motors 60 as corresponding to the operation direction (turning direction) and the operation angle of the steering wheel 52.

The remote control ECU 58 is also connected to the watercraft control CAN 75. Further, the controller 81 is connected to the watercraft control CAN 75. Therefore, the controller 81 can acquire information about the output command from the remote control ECU 58.

The controller 81 can acquire various information from the plurality of watercraft devices connected to the propulsion device control CAN 76, more specifically, from the helm ECU 54, the engine ECUs 63, and the steering ECUs 72, via the remote control ECU 58.

Therefore, the controller 81 can acquire information about the steering command outputted by the helm ECU 54. For example, the controller 81 can acquire the information about the steering command received by the steering ECUs 72, and information about detection results obtained by various sensors 73 provided in each of the steerings 70. The sensors 73 include, for example, a steering angle sensor. The steering angle sensor detects the actual steering angle of the corresponding outboard motor 60. The steering angle sensor may detect the operation amount of the steering actuator 71. Further, the controller 81 can acquire various information from the engine ECUs 63. For example, the controller 81 can acquire the information about the output command received by the engine ECUs 63, and information about detection results obtained by various sensors 64 provided in each of the outboard motors 60. The sensors 64 include, for example, a throttle opening degree sensor, an engine rotation speed sensor, and an engine temperature sensor. The throttle opening degree sensor is able to detect the opening degree of the throttle valve of the engine 61. The engine rotation speed sensor is able to detect the rotation speed of the engine 61, and may be a crank angle sensor. The engine ECUs 63 may be each able to process the output of the crank angle sensor to generate engine rotation speed information. The engine temperature sensor may be able to detect the temperature of the cylinder block of the engine 61 (e.g., the temperature of cooling water), or may be able to detect the exhaust temperature of the engine 61.

A gauge 82 that displays various information is connected to the watercraft control CAN 75. Further, the communication terminal 1 is connected to the watercraft control CAN 75. The communication terminal 1 is configured to transmit information about the situation of the watercraft 5 and the like to the server 2 (see FIG. 1). More specifically, the communication terminal 1 is configured to transmit configuration information indicating the configuration of the watercraft 5 (particularly, the onboard system 80), failure information indicating a failure occurring in the onboard system 80, the detection values of the sensors, and the like to the server 2.

The gauge 82 functions, for example, as a display that displays a residual fuel amount, the engine rotation speeds and the shift positions of the respective outboard motors 60, a residual battery capacity, and the like. The residual battery capacity is the residual capacity of a battery 88 mounted on the hull 51 to actuate starter motors (not shown) incorporated in the respective outboard motors 60 to start the engine. The battery 88 discharges to start the engine, and is charged by power generators (not shown) incorporated in the respective outboard motors 60 during the operation of the engines 61. The gauge 82 may include an input device 83 such as input buttons and a touch panel. The input device 83 may be operated by the watercraft operator to input various commands. The input device 83 may be provided separately from the gauge 82.

Additionally, various watercraft devices may be connected to the watercraft control CAN 75 in a data communicable manner. A third parties' watercraft devices (e.g., aftermarket devices) are typically connected to the watercraft control CAN 75 via a gateway 84. In FIG. 2, a GPS (Global Positioning System) receiver 85, a fish finder 86, and an autopilot device 87 are illustrated as examples of the third parties' watercraft devices. The GPS is a specific example of a GNSS (Global Navigation Satellite System).

The steering wheel 52 and the remote controller 55 are disposed in association with a helm seat, and main switches 78 operable to turn on and off power supply to the respective outboard motors 60 and to start and stop the engines 61 of the respective outboard motors 60 are also disposed in association with the helm seat. A kill switch 79 (emergency stop switch) operable to nullify the propulsive forces of the outboard motors 60 (typically to stop the engines 61) in an emergency is provided in association with the helm seat. The kill switch 79 includes, for example, an operation end to which a lanyard cable carried by the watercraft operator is connected. When the watercraft operator falls overboard, the kill switch 79 is actuated for the emergency stop of the engines 61 of the outboard motors 60.

Figure 3:
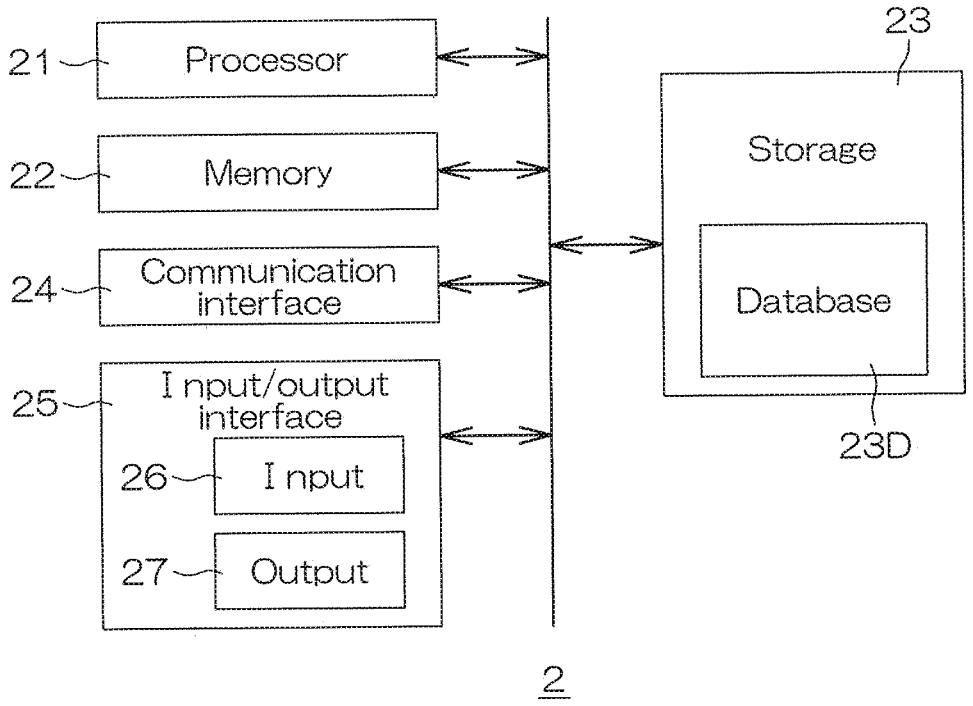
FIG. 3 is a block diagram showing a configuration of a server by way of example.

FIG. 3 is a block diagram showing the configuration of the server 2 by way of example. The server 2 includes a basic configuration as a computer. That is, the server 2 includes a processor 21, a memory 22, a storage 23, a communication interface 24, and an input/output interface 25, which are connected to each other in a data communicable manner in the server 2.

The processor 21 executes a program stored in the memory 22 to perform various functions. Specifically, the processor 21 includes the function of communicating with the communication terminal 1 (see FIG. 1), collecting data from the communication terminal 1, and accumulating the data in the storage 23. Further, the processor 21 includes the function of evaluating the onboard system 80 based on the accumulated information to generate an evaluation result. The storage 23 provides a storage area for the accumulation of the data. The communication interface 24 interfaces with the network 4 for communications. The input/output interface 25 includes an input device 26 (e.g., a keyboard) and an output device 27 (e.g., a display device) to provide a man-machine interface.

A database 23D is provided in the storage 23. For a plurality of watercraft, configuration information indicating the configuration of the onboard system 80 of each individual watercraft is accumulated in the database 23D. The configuration information to be accumulated includes configuration information transmitted from the communication terminal 1 of each individual watercraft 5. The configuration information includes information about one or more watercraft devices of the onboard system 80. The configuration information about the plurality of watercraft devices may include the types (model names), the component numbers, the serial numbers, the software names, the software versions and the like of the plurality of watercraft devices. The configuration information may include information about at least one (preferably all) of the number, the layout, and the connection states of the plurality of watercraft devices. Particularly, the configuration information preferably includes information about the types (model names), the number, the layout and the connection states of the outboard motors 60 as the main devices and the steerings 70 respectively incorporated in the outboard motors 60.

For various watercraft devices to be mounted on the watercraft 5, requirement information (operation conditions) required for proper operation of each individual watercraft device in the onboard system 80 is registered in the database 23D. For example, the requirement information includes hardware requirements and/or software requirements that are essential or permissible when the plurality of watercraft devices are each mounted on the watercraft 5. The hardware requirements include, for example, requirements for other essential or permissible devices (model names, component names and the like) to be provided together with each individual device in the onboard system 80. The software requirements include, for example, requirements for essential or permissible software (software name, software version and the like) for the other devices to be provided together with each individual device in the onboard system 80.

When the configuration information about the onboard system 80 is received from the communication terminal 1, the processor 21 retrieves requirement information from the database 23D to evaluate the onboard system 80, and generates an evaluation result. More specifically, the processor 21 determines the compatibility among the plurality of watercraft devices of the onboard system 80, and generates an evaluation result including a system compatibility determination result. When there is no problem with the compatibility among the plurality of watercraft devices and the proper operation of each individual watercraft device is confirmed, the system compatibility determination result is acceptable. When there is a possibility that at least one of the plurality of watercraft devices does not properly operate with some problem, the system compatibility determination result is unacceptable. The processor 21 transmits the system compatibility determination result to the communication terminal 1 via the communication interface 24. When the system compatibility determination result is unacceptable, the processor 21 may generate information about an unacceptable matter and/or information about a coping method to eliminate the unacceptable matter, and transmit the information to the communication terminal 1.

Figure 4:
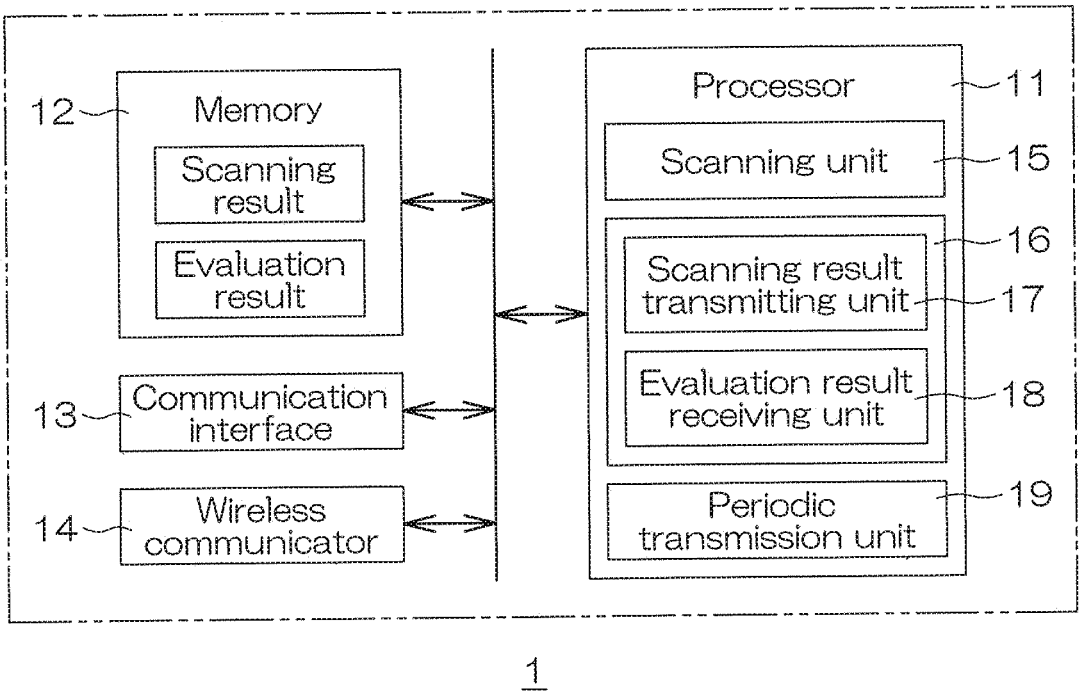
FIG. 4 is a block diagram showing a configuration of a communication terminal by way of example.

FIG. 4 is a block diagram showing the configuration of the communication terminal 1 by way of example. The communication terminal 1 includes a processor 11, a memory 12, a communication interface 13, and a wireless communicator 14. The processor 11 is a processing device that operates according to a program stored in the memory 12 to perform a plurality of functions. The communication interface 13 is an interface for data communications via the onboard network 77. The wireless communicator 14 performs data communications with the server 2 via the network 4.

The processor 11 performs a data collecting function to collect information from the devices provided in the hull 51 via the onboard network 77 and store the collected information in the memory 12. The information to be collected includes configuration information about the devices (watercraft devices) provided on the hull 51. The information to be collected may further include the detection values of the various sensors. Specifically, the detection values of the sensors 53, 57, 64, 73 respectively connected to the helm ECU 54, the remote control ECU 58, the engine ECUs 63, and the steering ECUs 72 can be collected. The information to be collected may further include information generated by the helm ECU 54, the remote control ECU 58, the engine ECUs 63, and the steering ECUs 72. Such information may include control information (control commands and other data) generated in the respective ECUs, trouble information (error codes) detected by the respective ECUs, and the like. As described above, the main switches 78, the kill switch 79, a start switch, and other switches may be regarded as sensors, and the states of these switches may be collected as detection values. Further, the processor 11 may have a trouble detecting function to monitor the states of the various devices connected to the onboard network 77 and generate the trouble information (failure information). For example, the processor 11 may monitor the states of the respective ECUs, and detect operation interruption due to instantaneous drop of the supply voltage as a trouble (instantaneous power outage). The collected information, the generated trouble information and the like are stored in the memory 12. There is no need to collect the information from all the devices connected to the onboard network 77. For example, information from the third parties' devices connected via the gateway 84 may be excluded.

The processor 11 functions to cause the wireless communicator 14 to transmit all or a portion of the information collected and/or generated by itself and stored in the memory 12 to the server 2.

In an example embodiment, the processor 11 functions as a scanning unit (scanner) 15 that performs a system scanning operation to collect, via the communication interface 13, the configuration information about the plurality of watercraft devices connected to the onboard network 77. Further, the processor 11 functions as a communication unit (communicator) 16 to perform data communications with the server 2 via the wireless communicator 14. The function as the communication unit 16 includes a function as a scanning result transmitting unit 17 that performs a scanning result transmitting operation to cause the wireless communicator 14 to transmit the information collected by the system scanning operation as the scanning result to the server 2. The server 2 receives the scanning result, registers the scanning result as the configuration information about the onboard system 80 in the database 23D, evaluates the onboard system 80 based on the configuration information, and transmits the result of the evaluation to the communication terminal 1. The function of the processor 11 as the communication unit 16 further includes a function as an evaluation result receiving unit 18 that performs an evaluation result receiving operation to cause the wireless communicator 14 to receive the evaluation result from the server 2. As described above, the evaluation result includes the system compatibility determination result. When the system compatibility determination result is unacceptable, the evaluation result includes information about an unacceptable matter and/or a coping method to be used to cope with or resolve the unacceptable matter.

The processor 11 stores the information collected by the system scanning operation as the scanning result in the memory 12. In an example embodiment, the memory 12 is used as a scanning result memory. Further, the processor 11 stores the evaluation result (system compatibility determination result) received from the server 2 in the memory 12. In an example embodiment, the memory 12 is also used as an evaluation result memory.

The processor 11 performs the system scanning operation at the startup of the onboard system 80. Further, the processor 11 performs the system scanning operation when the configuration of the onboard system 80 is changed by incorporating a new watercraft device in the onboard network 77.

Further, the processor 11 functions as a periodic transmission unit 19 that performs a periodic transmission operation to transmit predetermined periodic transmission information to the server 2 in a predetermined periodic transmission cycle during the operation of the onboard system 80. The periodic transmission cycle may be, for example, about 10 minutes. The periodic transmission information includes at least operation information indicating the operation state of the propulsion device (outboard motors 60). The periodic transmission information is uploaded to the server 2 and accumulated in the database 23D, and is mainly used to later check the presence or absence of abnormality, an abnormality occurrence state, and the like.

The periodic transmission information includes an error code as required. Specifically, when an error code indicating the presence of an error appears on the onboard network 77 at the startup of the onboard system 80, the error code is contained in the periodic transmission information. When the error code is thereafter changed during the operation of the onboard system 80, the changed error code is contained in the periodic transmission information. The error code may be transmitted to the server 2 separately from the periodic transmission operation.

Figure 5:
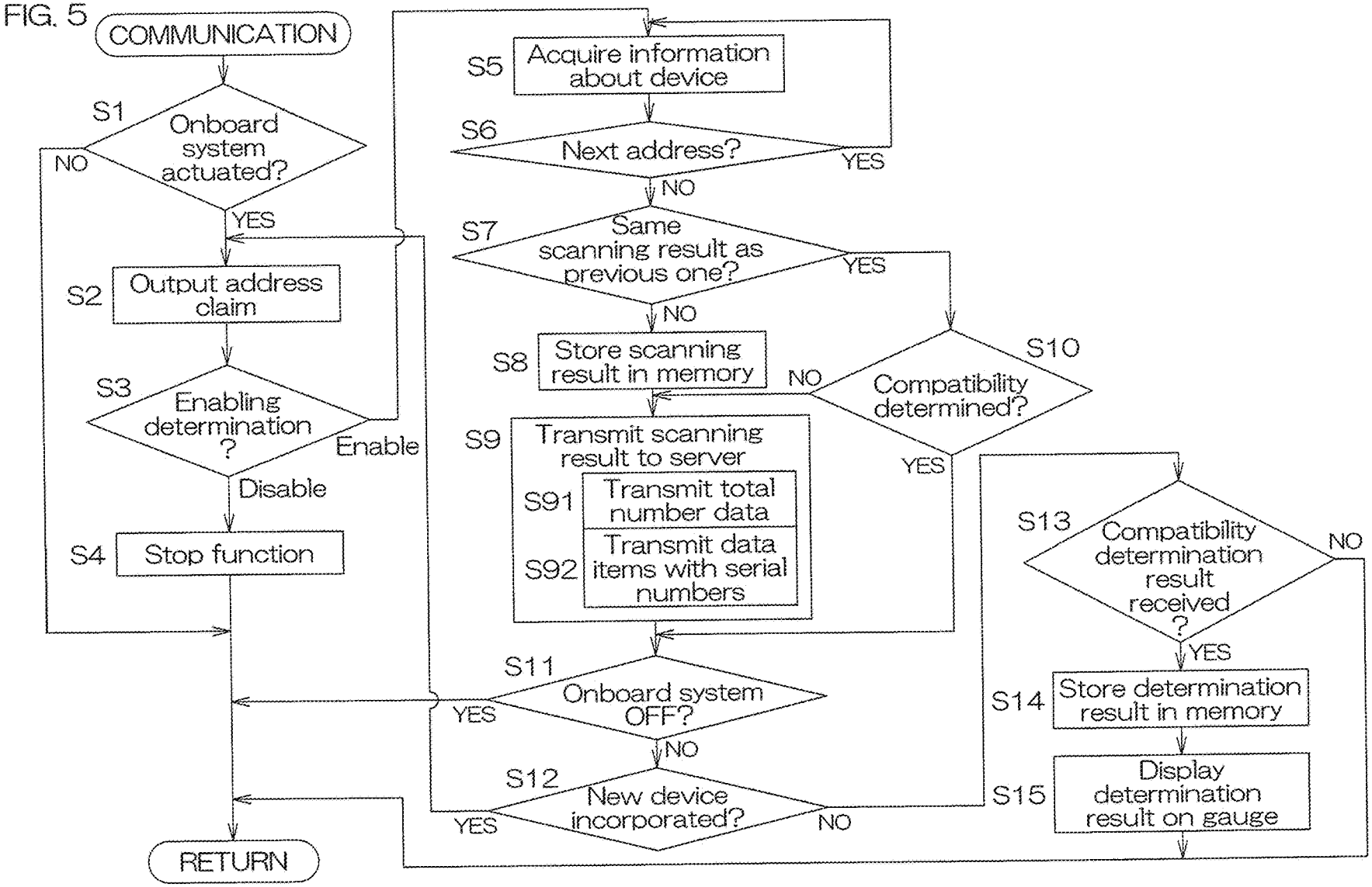
FIG. 5 is a flowchart for describing an operation of the communication terminal by way of example.

FIG. 5 is a flowchart for describing the operation of the communication terminal 1 by way of example, mainly showing a process to be periodically performed by the processor 11. The communication terminal 1 monitors the actuation of the onboard system 80. When the onboard system 80 is actuated (YES in Step S1), the communication terminal 1 performs a watercraft device information acquiring process to acquire information about the plurality of watercraft devices connected to the onboard network 77. For example, the communication terminal 1 may determine that the onboard system 80 is actuated when a message is outputted from any of the plurality of watercraft devices to the onboard network 77. More specifically, the communication terminal 1 may determine that the onboard system 80 is actuated when the message appears on the watercraft control CAN 75.

In order to acquire the information about the plurality of watercraft devices connected to the onboard network 77, the communication terminal 1 acquires the addresses of the plurality of watercraft devices connected to the watercraft control CAN 75 (Step S2). For the acquisition of the addresses, the communication terminal 1 may perform an address claim procedure to output an address claim to the onboard network 77 (specifically, the watercraft control CAN 75) to claim its own address. The plurality of watercraft devices connected to the watercraft control CAN 75 are each configured to output an address claim to claim an address to be used thereby in response to the address claim outputted to the watercraft control CAN 75 by the communication terminal 1. Thus, the communication terminal 1 can acquire the addresses of the respective watercraft devices connected to the watercraft control CAN 75 by outputting the address claim to the watercraft control CAN 75.

Then, the communication terminal 1 checks if a second communication terminal including substantially the same function is connected to the onboard network 77 (more specifically, the watercraft control CAN 75), and performs an enabling determination process to determine whether or not its own function is to be enabled (Step S3). The communication terminal 1 stops its function (Step S4) when its function should be disabled, and ends the process. The communication terminal 1 goes to the next step when its function should be enabled. The enabling determination process will be described below in detail.

Next, the communication terminal 1 performs the system scanning operation. Specifically, the communication terminal 1 transmits a configuration information transmission request to one of the plurality of watercraft devices connected to the onboard network 77 (more specifically, the watercraft control CAN 75) at any specific one of the acquired addresses. In response to the request, the watercraft device at the specific address transmits its configuration information to the communication terminal 1. The communication terminal 1 receives the configuration information, and stores the configuration information in the memory 12. Thus, the configuration information about the watercraft device is acquired (Step S5). This process is performed repeatedly for all the plurality of watercraft devices at the acquired addresses (Step S6) such that the configuration information is acquired for all the plurality of watercraft devices connected to the onboard network 77.

The remote control ECU 58 collects information from the plurality of watercraft devices (the helm ECU 54, the engine ECUs 63, and the steering ECUs 72) connected to the propulsion device control CAN 76. That is, upon reception of the configuration information transmission request, the remote control ECU 58 not only transmits its configuration information to the communication terminal 1 but also collects configuration information about the plurality of watercraft devices connected to the propulsion device control CAN 76 and transmits the configuration information to the communication terminal 1. Thus, the configuration information is collected for all the plurality of watercraft devices connected to the onboard network 77. The configuration information thus acquired by the system scanning operation is the scanning result, and the data indicating the scanning result is referred to as "scanning result data." The configuration information about the communication terminal 1 itself is also contained in the scanning result data.

The communication terminal 1 reads out previous scanning result data from the memory 12, and compares new (latest) scanning result data with the previous scanning result data to determine whether the new scanning result and the previous scanning result are consistent or inconsistent with each other (Step S7). When the previous scanning result data is not stored in the memory 12, the result of the determination is inconsistent. When the new scanning result is inconsistent with the previous scanning result (NO in Step S7), the communication terminal 1 stores the new scanning result data in the memory 12 (Step S8), and transmits the new scanning result data to the server 2 (Step S9).

When the new scanning result is consistent with the previous scanning result (YES in Step S7), on the other hand, the communication terminal 1 checks if data indicating the system compatibility determination result (system compatibility determination result data) is stored in the memory 12. When the system compatibility determination result data is stored in the memory 12 and the system compatibility determination result data indicates an acceptable result (YES in Step S10), the communication terminal 1 does not transmit the scanning result data to the server 2. That is, where it has been determined that the compatibility among the plurality of watercraft devices of the onboard system 80 is acceptable, the onboard system 80 is properly constructed and, therefore, the communication terminal 1 does not transmit the scanning result data to the server 2. In this case, the communication terminal 1 does not need to store the new scanning result data in the memory 12. Of course, the new scanning result data may be stored in the memory 12. When the system compatibility determination result data is not stored in the memory 12 or the system compatibility determination result data indicates an unacceptable result (NO in Step S10), the communication terminal 1 transmits the scanning result data to the server 2 even when the new scanning result is consistent with the previous scanning result (YES in Step S7).

The transmission of the scanning result data from the communication terminal 1 to the server 2 includes the transmission of a total number data (Step S91) and the transmission of data items the number of which is indicated by the total number data (Step S92). The total number data indicates the total number of the data items. The data items each include a data body indicating the configuration information collected from each individual watercraft device, and serial number data. The transmitted scanning result data includes at least one data item for each individual watercraft device. The serial number data indicates serial numbers, which may be assigned in the order of transmission. The serial numbers are consecutive integers (typically, consecutive incremental integers) starting with a predetermined initial value (typically, 0 or 1). The data body includes the configuration information about the watercraft device. The configuration information contained in the data body includes hardware information specifying the hardware configuration of the watercraft device. The hardware information includes a watercraft device type, a component number, a serial number and the like. The watercraft device type identifies a device type, e.g., a remote control ECU, an engine ECU, a steering ECU, a helm ECU or the like. The component number specifically identifies a device model name or the like. The serial number is an individual identification number assigned to each individual device. The configuration information often includes software information specifying the software configuration of the watercraft device (e.g., an ECU). The software information includes, for example, a software name, a software version, or the like.

After the completion of the transmission of the scanning result data, the communication terminal 1 checks the operation state of the onboard system 80. When the onboard system 80 is in operation (NO in Step S11), i.e., when the power-on state is continued, the communication terminal 1 further determines whether or not a new watercraft device is additionally incorporated in the onboard system 80 (Step S12). When a new watercraft device connectable to the onboard network 77 is connected to the onboard network 77 and actuated, the new watercraft device performs the address claim procedure, i.e., outputs an address claim to the onboard network 77 to claim an address to be used thereby. By detecting the address claim, the communication terminal 1 detects that the new watercraft device is incorporated in the onboard system 80. The connection of new hardware to the onboard network 77 and the incorporation of new software in the connected hardware are regarded as the incorporation of the new watercraft device.

When the addition of the new watercraft device is detected (YES in Step S12), the communication terminal 1 performs a process sequence from Step S2. That is, the system scanning operation is performed. Thus, information about the plurality of watercraft devices of the onboard system 80 modified in configuration by the addition of the new watercraft device (new scanning result) is acquired.

When the onboard system 80 is not changed in configuration without the addition of the new watercraft device (NO in Step S12), the communication terminal 1 checks if the system compatibility determination result data is received from the server 2 (Step S13). When the system compatibility determination result data is received from the server 2 (YES in Step S13), the data is stored in the memory 12 (Step S14). Further, the communication terminal 1 transmits the system compatibility determination result data to the gauge 82. Thus, the gauge 82 displays the system compatibility determination result on its screen (Step S15).

Immediately after the onboard system 80 is constructed and immediately after the onboard system 80 is modified, for example, the gauge 82 displays information such that the system scanning operation is not performed yet. The gauge 82 may display a message "PERFORM SYSTEM SCANNING OPERATION" in a popup manner. This information is provided mainly to a service person of a boat builder or a dealer. The gauge 82 continuously displays this information until the system compatibility determination result data indicating the acceptable compatibility is written.

When the communication terminal 1 writes the system compatibility determination result data received from the server 2 on the gauge 82 and the system compatibility determination result data indicates the acceptable compatibility, the gauge 82 deletes the displayed information (e.g., the popup information). When the system compatibility determination result data indicates unacceptable compatibility, the gauge 82 displays information indicating the unacceptable compatibility. Where the system compatibility determination result data includes information indicating the cause of an unacceptable matter and/or a coping method to be used to cope with or resolve the unacceptable matter, the gauge 82 may also display this information.

The boat builder or the dealer has a service-dedicated tool to troubleshoot the onboard system 80. The service-dedicated tool is typically a personal computer, and executes a dedicated application to function as a troubleshooting device. The service-dedicated tool is connected to the onboard network 77 such that the system scanning operation described above can be performed with the use of the service-dedicated tool. Further, the service-dedicated tool includes a communication function to communicate with the server 2. Therefore, the use of the service-dedicated tool makes it possible to perform the system scanning operation, to transmit the scanning result to the server 2, and to receive the system compatibility determination result, like with the use of the communication terminal 1. In addition to these functions, the service-dedicated tool may have the function of, for example, downloading latest software for a watercraft device from the server and installing the latest software in the watercraft device.

Figure 6:
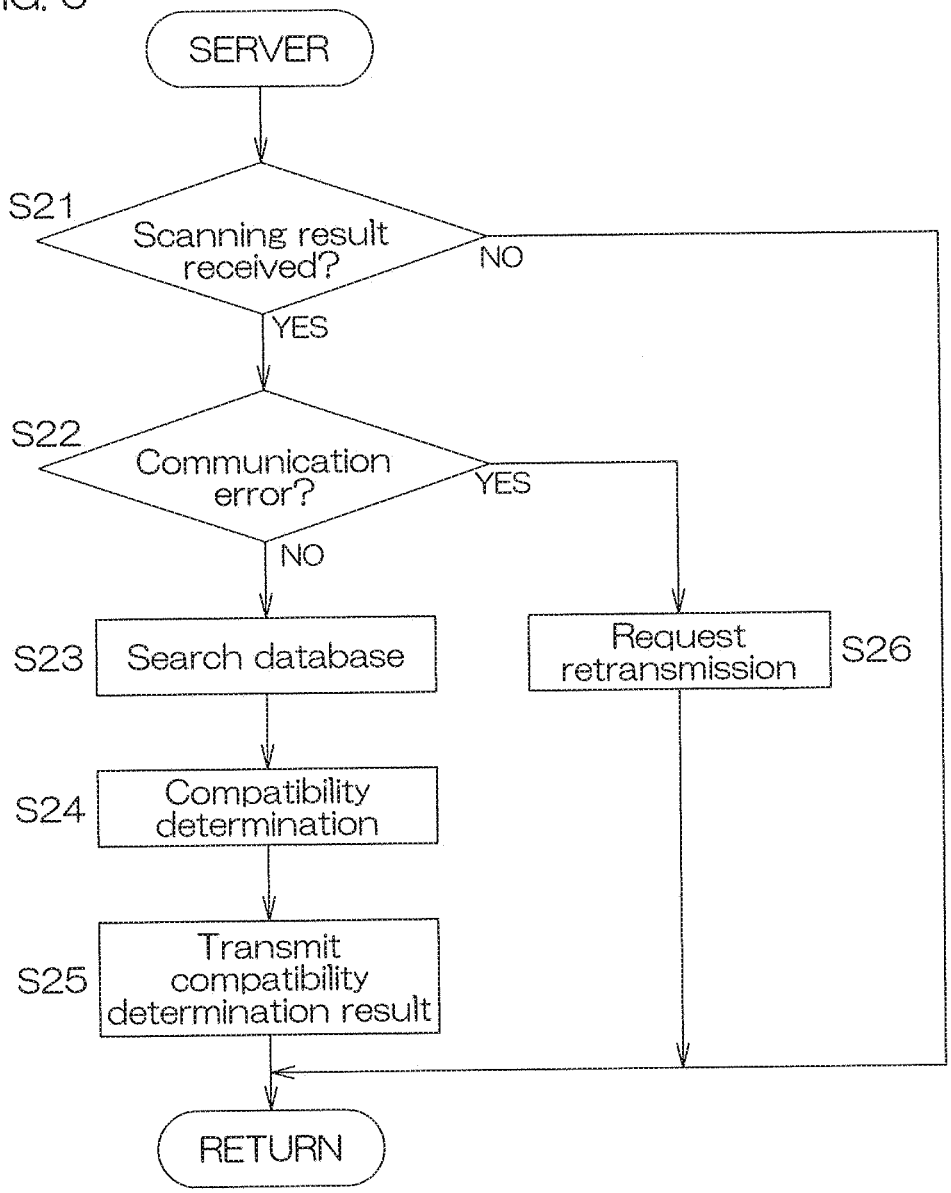
FIG. 6 is a flowchart for describing an exemplary system compatibility determination process to be performed in the server.

FIG. 6 is a flowchart for describing an exemplary system compatibility determination process to be performed in the server 2, mainly showing a process to be periodically performed by the processor 21. The server 2 receives the scanning result data from the communication terminal 1 of the watercraft 5 (Step S21). The server 2 determines, based on the serial numbers of the data items and the total number data contained in the scanning result data, whether or not a communication error is present (Step S22). Specifically, when data items of a number indicated by the total number data are all received, the server 2 determines that no communication error is present. When the number of the received data items is smaller than the total number indicated by the total number data (or when the number of the received data items is zero) such that the communication ends, on the other hand, the server 2 determines that a communication error is present. When it is determined that the communication error is present (YES in Step S22), the server 2 requests the communication terminal 1 to retransmit the scanning result data (Step S26). The server 2 may determine an unreceived (missing) data item based on the serial number of the data item. In this case, the server 2 may provide information specifying the unreceived data item to the communication terminal 1. The communication terminal 1 may retransmit only the missing data item, or may retransmit the entire scanning result data.

When it is determined that no communication error is present (NO in Step S22), the server 2 searches the database 23D (Step S23), and collects information about a watercraft device specified by the data body of the data item.

In the database 23D, the requirement information required for the proper operation is stored for each of the plurality of watercraft devices. The requirement information typically includes essential requirement information indicating essential requirements for the proper operation of the device. Examples of the requirements include information about the other watercraft devices to be provided in the same onboard system, and software information about the other watercraft devices.

The server 2 determines, based on the scanning result data, whether or not the requirement information is satisfied for each of the plurality of watercraft devices to thus determine whether the compatibility among the plurality of watercraft devices of the onboard system 80 is acceptable or unacceptable (Step S24). The result of the compatibility determination is transmitted as the system compatibility determination result data to the communication terminal 1 (Step S25).

When the result of the compatibility determination is unacceptable, the server 2 preferably specifies unacceptable requirement information, and transmits the unacceptable requirement information as unacceptable matter information to the communication terminal 1. The unacceptable matter information may include information about a coping method to eliminate the unacceptable matter instead of the information about the unacceptable matter or in addition to the information about the unacceptable matter. As described above, the unacceptable matter and/or the coping method may be displayed on the gauge 82 of the onboard system 80. For example, a message "ENGINE ECU CONTAINS OLD ROM INFORMATION. REWRITE ECU." may be displayed on the gauge 82.

Further, where new software is available on any of the plurality of watercraft devices of the onboard system 80, the server 2 may inform the communication terminal 1 about the availability of the new software. In this case, the server 2 preferably preliminarily confirms that the compatibility determination result is acceptable even after the new software is incorporated. The communication terminal 1, when being informed about the availability of the new software, preferably displays the availability of the new software on the gauge 82. This can prompt a user or an operator to use the new software.

The new software can be incorporated (installed) in the plurality of watercraft devices by connecting the service-dedicated tool to the onboard network 77. The communication terminal 1 may have the function of downloading the new software from the server 2. Then, the incorporation (installation) of the software in the plurality of watercraft devices may be achieved, for example, by using the gauge 82 and the input device 83 as man-machine interfaces.

Figure 7:
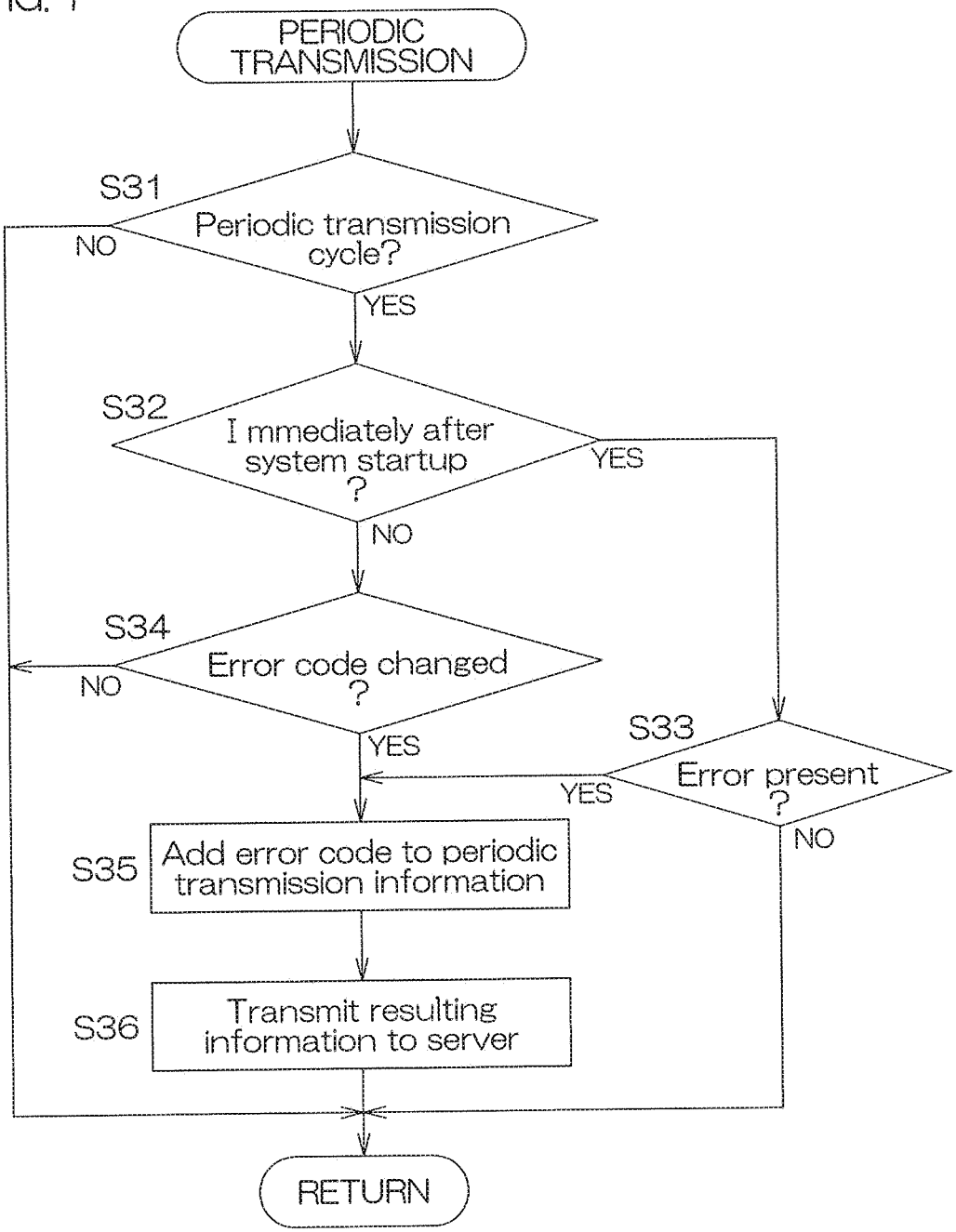
FIG. 7 is a flowchart for describing an exemplary periodic transmission process to be performed by the communication terminal.

FIG. 7 is a diagram for describing an exemplary periodic transmission process to be performed by the communication terminal 1 during the operation of the onboard system 80. In every periodic transmission cycle (YES in Step S31), the communication terminal 1 transmits the periodic transmission information to the server 2.

The periodic transmission information includes the operation information about the outboard motors 60, more specifically, engine operation information. The engine operation information includes, for example, information about operation periods for a plurality of predefined rotation speed ranges. The engine operation information may further include information about the number of times of overspeed rotation states, the number of times of overheat states, the number of times of low hydraulic pressure states, the number of times of knocking control states, the number of times of reverse rotation states, and the like. The periodic transmission information may further include information about the detection values of the various sensors. The communication terminal 1 periodically collects the engine operation information and the detection values of the various sensors from the plurality of watercraft devices via the onboard network 77. The cycle of the periodic collection is shorter than the periodic transmission cycle.

The communication terminal 1 further performs an error code collecting process to collect error codes outputted from the respective watercraft devices to the onboard network 77. The error codes each indicate the presence or absence of an error in each of the devices, and the type of the error. The plurality of watercraft devices each output an error code to the onboard network 77 at the startup of the onboard system 80, and further periodically output an error code to the onboard network 77 after the startup of the onboard system 80.

When the communication terminal 1 receives an error code indicating the presence of an error (YES in Step S33) immediately after the startup of the onboard system 80 (YES in Step S32), the communication terminal 1 adds the error code to the periodic transmission information (Step S35), and transmits the resulting periodic transmission information to the server 2 (Step S36). When the error code indicating the presence of an error is not received (NO in Step S33), the error code is not added to the periodic transmission information. Thereafter, the communication terminal 1 checks if any error code is changed (Step S34). When any error code is changed as compared with the error code received in the previous periodic transmission cycle (YES in Step S34), the communication terminal 1 adds the changed error code to the periodic transmission information (Step S35), and transmits the resulting periodic transmission information to the server 2 (Step S36). An error code left unchanged is not transmitted.

Figure 8:
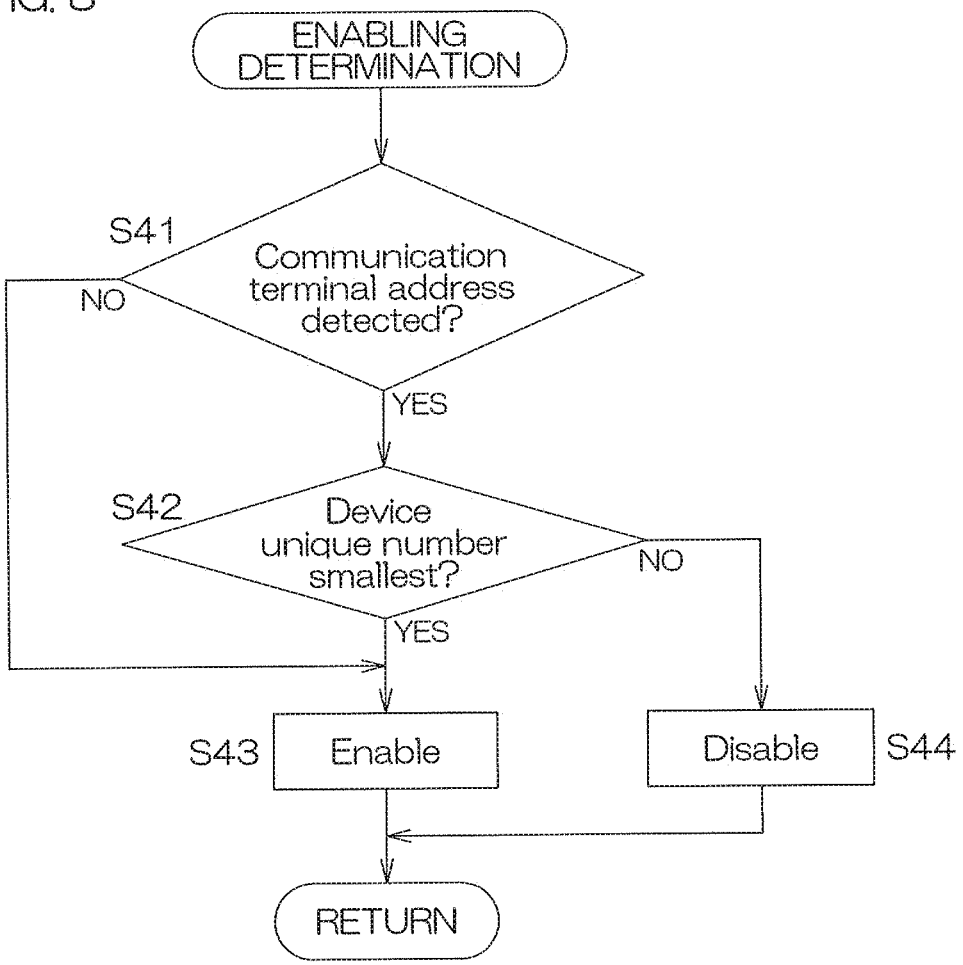
FIG. 8 is a flowchart for describing an exemplary enabling determination process to be performed by the communication terminal.

FIG. 8 is a flowchart for describing an exemplary enabling determination process (Step S3 in FIG. 5) to be performed by the communication terminal 1. The onboard system 80 is typically designed to include only one communication terminal 1. In the address claim procedure, the plurality of watercraft devices designed to be connectable to the onboard network 77 each claim the use of an address assigned thereto according to the device type. Therefore, the claimed address is an example of the type specification information that specifies the device type of the watercraft device. Specifically, the communication terminal 1 claims the use of an address predetermined to be used thereby in the address claim procedure (hereinafter referred to as "communication terminal address"). When two or more communication terminals 1 are connected to the onboard system 80, these communication terminals 1 claim the use of the same address, resulting in an address conflict (address overlap). Therefore, negotiation among the plurality of communication terminals 1 is necessary to determine a priority communication terminal 1 out of the communication terminals 1. Here, description will be given to an exemplary negotiation process to be performed by using a unique number which is hardware identification information (individual identification information) applied to each individual watercraft device. In the address claim procedure, the plurality of watercraft devices each claim an address and, in addition, each output information including the unique number to the onboard network 77.

The communication terminal 1 enables its function (Step S43), when none of the other watercraft devices claims the use of the communication terminal address in the address claim procedure (NO in Step S41). When the communication terminal 1 detects that another of the plurality of watercraft devices claims the use of the communication terminal address in the address claim procedure (YES in Step S41), on the other hand, the communication terminal 1 determines that a second communication terminal 1 is connected to the onboard network 77. Then, the communication terminal 1 compares its own unique number with the unique number of the watercraft device (i.e., the second communication terminal 1) claiming the use of the communication terminal address (Step S42).

When the unique number of the first communication terminal 1 is smaller than the unique number of the second communication terminal 1 (YES in Step S42), the first communication terminal 1 enables its own function (Step S43). When a plurality of second communication terminals 1 are present and the unique number of the first communication terminal 1 is smaller than the unique number of any of the second communication terminals 1, the first communication terminal 1 enables its own function.

When the unique number of the first communication terminal 1 is greater than the unique number of the second communication terminal 1 (NO in Step S42), the first communication terminal 1 disables its own function to stop the function. When a plurality of second communication terminals 1 are present and the unique number of the first communication terminal 1 is greater than the unique number of at least one of the second communication terminals 1, the first communication terminal 1 disables its own function to stop the function (Step S44). The stop of the function herein specifically means that at least the system scanning function and the scanning result transmitting function are stopped. For example, the communication terminal 1 with its function stopped may operate in a read only mode to simply read information appearing on the onboard network 77 without outputting any signal to the onboard network 77.

The function of only one of the communication terminals 1 is enabled by performing the same process on the other communication terminals 1 connected to the onboard network 77. This makes it possible to avoid function confliction (function overlap) among the communication terminals 1.

When the plurality of communication terminals 1 are connected to the single onboard network 77 and each transmit information to the server 2, the server 2 receives the information about the single onboard system 80 in an overlapping manner. This results in a disadvantageous overlapping process in the server 2. The enabling determination process described above provides that the single communication terminal 1 can communicate with the server 2 to reduce the load on the server 2.

On the other hand, an arrangement such that the plurality of communication terminals 1 are connected to the onboard network 77 is advantageous because, even when one of the communication terminals 1 fails, another of the communication terminals 1 can communicate with the server 2. When the failing communication terminal 1 does not respond to the address claim at the startup of the onboard system 80, for example, the failing communication terminal 1 is automatically excluded from objects to be subjected to the enabling determination process. Thus, the function of the communication terminal 1 free from the failure (particularly, the system scanning function and the scanning result transmitting function) is enabled, thus providing the proper communication between the communication terminal 1 and the server 2.

In an example embodiment, as described above, the plurality of watercraft devices are connected to the onboard network 77 to provide the onboard system 80, and the communication terminal 1 is provided as one of the plurality of watercraft devices. The communication terminal 1 is communicable with the other watercraft devices via the onboard network 77, and is further communicable with the server 2 outside the watercraft 5. In an example embodiment, the communication terminal 1 performs the system scanning operation to collect the information about the plurality of watercraft devices, and transmits the scanning result to the server 2. In the server 2, the scanning result is evaluated, and the evaluation result is transmitted to the communication terminal 1.

Therefore, it is possible to perform the system scanning operation and acquire the evaluation result of the system scanning without connecting the service-dedicated tool not contained in the onboard system 80 to the onboard network 77. When the onboard system 80 is properly constructed and the result of the evaluation of the scanning result is correspondingly excellent, therefore, the troubleshooting operation requiring the connection of the service-dedicated tool can be omitted. Thus, the time and the effort required to troubleshoot the onboard system 80 can be reduced.

In an example embodiment, the communication terminal 1 performs the system scanning operation at the startup of the onboard system 80. Therefore, it is possible to perform the system scanning operation and acquire the evaluation result of the system scanning when the onboard system 80 is started up after the onboard system 80 is newly constructed or the configuration of the onboard system 80 is modified. In this case, the troubleshooting operation requiring the connection of the service-dedicated tool can be omitted when the onboard system 80 includes a proper configuration.

In an example embodiment, the communication terminal 1 performs the system scanning operation when the new watercraft device is connected to the onboard network 77. Therefore, it is possible to perform the system scanning operation and acquire the evaluation result of the system scanning when the new watercraft device is connected to the onboard network 77 to thus change the configuration of the onboard system 80 during the operation of the onboard system 80. In this case, the troubleshooting operation requiring the connection of the service-dedicated tool can be omitted when the onboard system 80 includes a proper configuration.

In an example embodiment, the communication terminal 1 stores the scanning result in the memory 12 (an example of the scanning result memory). The communication terminal 1 compares the new scanning result (which is the information newly collected by the system scanning operation) with the previous scanning result stored in the memory 12. When the new scanning result is inconsistent with the previous scanning result, the new scanning result is transmitted to the server 2 and evaluated by the server 2. When the new scanning result is consistent with the previous scanning result, on the other hand, the scanning result transmitting operation is omitted and, therefore, the scanning result is not evaluated in the server 2. This makes it possible to reduce the effort for the troubleshooting operation requiring the connection of the service-dedicated tool, while reducing the loads on the communication terminal 1 and the server 2.

Further, the communication terminal 1 stores the evaluation result received from the server 2 in the memory 12 (an example of the evaluation result memory). The communication terminal 1 performs the scanning result transmitting operation whether the information newly collected by the system scanning operation (new scanning result) is consistent or inconsistent with the previous information (previous scanning result) stored in the memory 12 when no evaluation result is stored in the memory 12. This prevents the scanning result from being left unevaluated by the server 2, making it possible to reliably evaluate whether or not the onboard system 80 is properly constructed.

In an example embodiment, the server 2 determines the compatibility among the plurality of watercraft devices to generate the evaluation result including the result of the compatibility determination (system compatibility determination result), and transmits the evaluation result to the communication terminal 1. Thus, the compatibility among the plurality of watercraft devices of the onboard system 80 is determined, making it possible to determine, based on the evaluation result, whether or not the plurality of watercraft devices properly operate.

In an example embodiment, the information (scanning result) to be transmitted to the server 2 by the communication terminal 1 includes the hardware information and the software information about each individual watercraft device. This makes it possible to evaluate the hardware compatibility and the software compatibility among the plurality of watercraft devices in the server 2.

In an example embodiment, the communication terminal 1 transmits the evaluation result received from the server 2 to the gauge 82, which in turn displays the evaluation result. That is, the gauge 82 which is one of the plurality of watercraft devices, functions as the display that displays the evaluation result received by the communication terminal 1. This makes it possible to know the evaluation result without the connection of the service-dedicated tool, thus reducing the time and the effort required for the troubleshooting operation.

In an example embodiment, the evaluation result includes the acceptability determination result indicating whether or not the onboard system 80 is properly constructed. In an example embodiment, the evaluation result may further include the information about the unacceptable matter and/or the information about the coping method to eliminate the unacceptable matter when the determination result is unacceptable. Such information makes it possible to know how the onboard system 80 should be corrected without the connection of the service-dedicated tool, even when the determination result is unacceptable. This reduces the time and the effort required to troubleshoot the onboard system 80.

In an example embodiment, the plurality of watercraft devices include the outboard motors 60 which are examples of the propulsion device to apply the propulsive force to the hull 51 of the watercraft 5. The communication terminal 1 transmits the operation information indicating the operation states of the outboard motors 60 to the server 2 during the operation of the onboard system 80. Specifically, the periodic transmission information including the operation information about the outboard motors 60 is uploaded to the server 2 in the periodic transmission cycle. Thus, the operation information about the outboard motors 60 can be accumulated in the server 2. Thus, the operation states of the outboard motors 60 can be checked based on the information accumulated in the server 2. In other words, the communication terminal 1 provided on the watercraft 5 in order to monitor the operation states of the outboard motors 60 can be used for the system scanning operation, the transmission of the scanning result, and the reception of the evaluation result from the server 2.

In an example embodiment, the communication terminal 1 informs the server 2 about the total number data indicating the total number of the data items to be transmitted to the server 2, and transmits the data items respectively assigned with the serial numbers to the server 2 in the scanning result transmitting operation. Then, the server 2 determines, based on the total number data and the serial numbers, whether or not all the scanning result data is received. Thus, the server 2 can confirm the reception of all the data based on the total number data and the serial numbers. That is, the server 2 can check whether or not the transmission error is present, i.e., whether or not there is missing data. When the transmission error is present, the server 2 informs the communication terminal 1 about the transmission error. In an example embodiment, the information about the transmission error is the retransmission request. In response to the retransmission request, the communication terminal 1 uploads at least the missing data to the server 2. Thus, all the scanning result data can be reliably transmitted to the server 2, so that the onboard system 80 can be properly evaluated in the server 2.

In an example embodiment, when the plurality of communication terminals 1 are connected to the onboard network 77 and conflict with each other, only one of the communication terminals 1 selected based on the predetermined rule is enabled to perform the system scanning operation and the scanning result transmitting operation, and the other of the communication terminals 1 are disabled from performing the system scanning operation and the scanning result transmitting operation. Thus, only one of the communication terminals 1 connected to the onboard network 77 performs the system scanning operation and the scanning result transmitting operation. Even when two or more communication terminals are connected to the onboard system 80, therefore, the communication terminals are prevented from performing the system scanning operation and/or the scanning result transmitting operation in an overlapping manner. Thus, the overlapping operations in the onboard system 80 can be eliminated. Since the overlapping information is not transmitted to the server 2, the load on the server 2 can be reduced. When the plurality of communication terminals 1 are connected to the onboard network 77 and one of the communication terminals 1 fails, on the other hand, another of the communication terminals 1 can function in place of the failing communication terminal. This makes it possible to provide proper communication with the server 2, thus reducing the time and the effort for the troubleshooting requiring the connection of the service-dedicated tool. In addition, it is also possible to provide the function of uploading the operation information about the outboard motors 60 to the server 2. In an example embodiment, as described above, the address claim procedure is used for the negotiation among two or more communication terminals 1 to prioritize the communication terminals 1.

In an example embodiment, the plurality of watercraft devices each output the error code indicating the presence or absence of the error thereof onto the onboard network 77 at the startup of the onboard system 80 and after the startup of the onboard system 80. The communication terminal 1 transmits the necessary error code to the server 2. The information about the error code is accumulated in the server 2 such that the troubleshooting can be performed on the onboard system 80 based on the accumulated information. When the error code indicating the presence of the error appears at the startup of the onboard system 80, the communication terminal 1 transmits the error code to the server 2. Otherwise, the communication terminal 1 transmits no error code. Thus, the server 2 can be informed about the presence of the error with a minimum amount of communications. Further, where the error code is changed after the startup of the onboard system 80, the communication terminal 1 transmits the error code to the server 2. Otherwise, the communication terminal 1 transmits no error code. Thus, the server 2 can be informed about the error states of the respective watercraft devices with a minimum amount of communications. The error code may indicate the type of the error as well as the presence or absence of the error. In this case, a greater amount of information can be accumulated in the server 2, making it possible to perform the troubleshooting more precisely.

While example embodiments of the present invention have thus been described, the present invention may be embodied in some other ways as will be described below by way of example.

In an example embodiment described above, the communication terminal 1, which is one of the plurality of watercraft devices of the onboard system 80, functions as the scanning unit 15 that performs the system scanning operation to collect the information about the plurality of watercraft devices via the onboard network 77. In addition, the communication terminal 1 functions as the communication unit 16 (the scanning result transmitting unit 17 and the evaluation result receiving unit 18) that transmits the scanning result to the server 2 and receives the evaluation result from the server 2. This arrangement may be modified, for example, so that the gauge 82 functions as the scanning unit and the communication terminal 1 functions as the communication unit (the scanning result transmitting unit and the evaluation result receiving unit).

For example, the scanning unit (the communication terminal 1 or the gauge 82) which is one of the plurality of watercraft devices of the onboard system 80 and a communication unit not in the onboard system 80 may be used in combination to define the communication terminal. In this case, the communication unit may be a mobile communication terminal such as a smartphone or a tablet. The scanning unit and the communication unit need to be capable of data communication therebetween. Proximity wireless communications typified by wireless LAN (Wi-Fi) and Bluetooth® may be used for the data communication. Where at least the scanning unit is one of the plurality of watercraft devices of the onboard system 80, the effort required for the troubleshooting operation can be significantly reduced.

In an example embodiment described above, the evaluation result (system compatibility determination result) received from the server 2 is displayed on the gauge 82 by way of example. Alternatively, an indicator such as a light emitting diode lamp may be provided on the communication terminal 1, so that the evaluation result can be indicated by the indicator.

In an example embodiment described above, the outboard motors are used as the propulsion device by way of example, but the propulsion device provided in the watercraft may be in any of various types such as inboard motors, inboard/outboard motors, and waterjet propulsion devices.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft troubleshooting system comprising:

an onboard system including a plurality of watercraft devices provided on a watercraft, and an onboard network provided on the watercraft and connected to the plurality of watercraft devices, the plurality of watercraft devices including a communication terminal communicable with others of the plurality of watercraft devices via the onboard network; and a server outside the watercraft and communicable with the communication terminal; wherein the communication terminal is configured or programmed to perform a system scanning operation to collect information about the plurality of watercraft devices, and to perform a scanning result transmitting operation to transmit the information collected by the system scanning operation as a scanning result to the server; and the server is configured or programmed to evaluate the scanning result transmitted thereto from the communication terminal to generate an evaluation result, and to transmit the evaluation result to the communication terminal; wherein the communication terminal includes a scanning result memory to store the scanning result, and is configured or programmed to perform the scanning result transmitting operation only when information newly collected as a new scanning result by the system scanning operation is inconsistent with the scanning result previously stored in the scanning result memory.

2. The watercraft troubleshooting system according to claim 1, wherein the communication terminal is configured or programmed to perform the system scanning operation at a startup of the onboard system.

3. The watercraft troubleshooting system according to claim 1, wherein the communication terminal is configured or programmed to perform the system scanning operation when a new watercraft device is connected to the onboard network.

4. The watercraft troubleshooting system according to claim 1, wherein the communication terminal includes an evaluation result memory to store the evaluation result transmitted thereto from the server, and is configured or programmed to perform the scanning result transmitting operation whether the new scanning result is consistent or inconsistent with the scanning result previously stored in the scanning result memory when no evaluation result is stored in the evaluation result memory.

5. The watercraft troubleshooting system according to claim 1, wherein the server is configured or programmed to determine compatibility among the plurality of watercraft devices to generate an evaluation result including a result of the compatibility determination, and to transmit the evaluation result to the communication terminal.

6. The watercraft troubleshooting system according to claim 5, wherein the scanning result to be transmitted to the server by the communication terminal includes hardware information and software information about each of the plurality of watercraft devices.

7. The watercraft troubleshooting system according to claim 1, wherein the plurality of watercraft devices include a display to display the evaluation result transmitted to the communication terminal.

8. The watercraft troubleshooting system according to claim 1, wherein the evaluation result includes an acceptability determination result indicating whether or not the onboard system is properly constructed, and further includes information about an unacceptable matter or a coping method to eliminate the unacceptable matter when the determination result is unacceptable.

9. The watercraft troubleshooting system according to claim 1, wherein the plurality of watercraft devices include a propulsion device to apply a propulsive force to a hull of the watercraft; and the communication terminal is configured or programmed to transmit operation information indicating an operation state of the propulsion device to the server during operation of the onboard system.

10. The watercraft troubleshooting system according to claim 9, wherein the propulsion device includes an outboard motor.

11. The watercraft troubleshooting system according to claim 1, wherein the communication terminal is configured or programmed to inform the server about a total number data indicating a total number of data items to be transmitted to the server, and to transmit the data items respectively assigned with serial numbers to the server in the scanning result transmitting operation; and the server is configured or programmed to determine, based on the total number data and the serial numbers, whether or not all the data items are received.

12. The watercraft troubleshooting system according to claim 1, wherein the communication terminal is configured or programmed so that, when a plurality of communication terminals are connected to the onboard network, only one of the plurality of communication terminals selected based on a predetermined rule is enabled to perform the system scanning operation and the scanning result transmitting operation, and other of the plurality of communication terminals are disabled from performing the system scanning operation and the scanning result transmitting operation.

13. The watercraft troubleshooting system according to claim 1, wherein the plurality of watercraft devices are each configured or programmed to output an error code indicating presence or absence of an error to the onboard network at startup of the onboard system and after the startup of the onboard system;

the communication terminal is configured or programmed to transmit the error code to the server when the error code indicating the presence of the error appears on the onboard network at the startup of the onboard system; and after the startup of the onboard system, the communication terminal is configured or programmed to transmit the error code to the server only when the error code is changed.

14. A watercraft comprising:

a hull; and the watercraft troubleshooting system according to claim 1.

15. A watercraft troubleshooting system comprising:

a plurality of watercraft devices provided on a watercraft;

an onboard network provided on the watercraft and connected to the plurality of watercraft devices;

a communication terminal communicable with the plurality of watercraft devices via the onboard network; and a server communicable with the communication terminal; wherein the communication terminal is configured or programmed to collect information about the plurality of watercraft devices and to transmit the collected information to the server; and the server is configured or programmed to evaluate the information transmitted thereto from the communication terminal to generate an evaluation result, and to transmit the evaluation result to the communication terminal; wherein the communication terminal includes a memory to store the collected information, and is configured or programmed to transmit the collected information only when newly collected information is inconsistent with the collected information previously stored in the memory.

16. The watercraft troubleshooting system according to claim 15, wherein the plurality of watercraft devices include a scanner to perform a system scanning operation to collect information about the plurality of watercraft devices via the onboard network; and the communication terminal includes the scanner, and a communicator to transmit the information collected by the scanner as a scanning result to the server and receive the evaluation result from the server.

17. A communication terminal provided on a watercraft and communicable with a server, the communication terminal comprising:

a communication interface connected to an onboard network provided on the watercraft;

a wireless communicator to communicate with the server; and a processor configured or programmed to function as:

a scanner to collect, via the communication interface, information about a device provided on the watercraft and connected to the onboard network;

a scanning result transmitter to cause the wireless communicator to transmit the information collected by the scanner as a scanning result to the server; and an evaluation result receiver to cause the wireless communicator to receive a result of evaluation of the transmitted information from the server; wherein the communication terminal further includes a scanning result memory to store the scanning result; and the scanning result transmitter causes the wireless communicator to transmit the scanning result only when information newly collected as a new scanning result by the system scanning operation is inconsistent with the scanning result previously stored in the scanning result memory.

* * * * *